US008595959B2

(12) United States Patent
Shepherd

(10) Patent No.: US 8,595,959 B2
(45) Date of Patent: Dec. 3, 2013

(54) SANDAL WITH DECORATED TOE PROTRUSIONS

(76) Inventor: Doug Shepherd, Johnstown, OH (US)

( * ) Notice: Subject to any disclaimer, the term of this patent is extended or adjusted under 35 U.S.C. 154(b) by 265 days.

(21) Appl. No.: 13/234,957

(22) Filed: Sep. 16, 2011

(65) Prior Publication Data

US 2012/0066936 A1 Mar. 22, 2012

Related U.S. Application Data

(60) Provisional application No. 61/383,868, filed on Sep. 17, 2010, provisional application No. 61/412,063, filed on Nov. 10, 2010.

(51) Int. Cl.
*A43B 23/00* (2006.01)

(52) U.S. Cl.
USPC ..... 36/137; 36/7.5; 36/11.5

(58) Field of Classification Search
USPC ..... 36/137, 7.5, 11.5; 362/103; D2/916
See application file for complete search history.

(56) References Cited

U.S. PATENT DOCUMENTS

| | | | | | |
|---|---|---|---|---|---|
| 2,931,893 | A | | 4/1960 | Arias et al. | |
| D228,701 | S | * | 10/1973 | Ostergaard | D2/899 |
| 4,848,009 | A | * | 7/1989 | Rodgers | 36/137 |
| 5,052,131 | A | * | 10/1991 | Rondini | 36/137 |
| 5,237,760 | A | | 8/1993 | Altman et al. | |
| 5,285,586 | A | | 2/1994 | Goldston et al. | |
| 5,343,445 | A | | 8/1994 | Cherdak | |
| 5,483,759 | A | | 1/1996 | Silverman | |
| 5,644,858 | A | | 7/1997 | Bemis | |
| 5,879,069 | A | | 3/1999 | Chien | |
| 7,089,691 | B1 | | 8/2006 | Silvera | |
| 7,255,468 | B2 | | 8/2007 | Capriola | |
| 2003/0145494 | A1 | * | 8/2003 | Hsu | 36/137 |
| 2004/0055179 | A1 | * | 3/2004 | Wang | 36/11.5 |
| 2005/0018417 | A1 | * | 1/2005 | Chien | 362/103 |
| 2006/0007668 | A1 | * | 1/2006 | Chien | 362/103 |
| 2006/0007670 | A1 | | 1/2006 | Chien | |
| 2006/0221596 | A1 | | 10/2006 | Chang | |
| 2006/0230642 | A1 | | 10/2006 | Vick et al. | |
| 2007/0144040 | A1 | * | 6/2007 | Chen | 36/137 |

* cited by examiner

*Primary Examiner* — Khoa Huynh
*Assistant Examiner* — Megan Brandon
(74) *Attorney, Agent, or Firm* — Wood, Herron & Evans, LLP

(57) ABSTRACT

A piece of footwear includes ornamental protrusions made to resemble toes. The toe-shaped protrusions stick out beyond the user's toes and may include toenails or other designs. Decorations on the surface of the toes, such as lights or removable ornaments, augment the toes' design. The decorations may take the form of lights within the protrusions that activate selectively in response to the wearer's movement. The lights may be visible within recesses in the protrusions or through transparent or translucent coverings over the protrusions. The decorations may also take the form of self-adhesive ornaments such as stickers or gems that are provided to the user, allowing the user to customize the look of the toe protrusions through selection and positioning of the ornaments thereon. Ornaments may also include symbols which can be arranged to convey a message selected by the user. Ornaments may be removed and replaced or interchanged as desired.

8 Claims, 5 Drawing Sheets

SANDAL WITH DECORATED TOE PROTRUSIONS

RELATED APPLICATIONS

This application claims the benefit of my prior provisional applications: U.S. Provisional Patent Application No. 61/383,868, filed Sep. 17, 2010, and U.S. Provisional Patent Application No. 61/412,063, filed Nov. 10, 2010.

FIELD OF THE INVENTION

The invention is generally related to footwear, and more particularly to sandals displaying artificial toe protrusions.

BACKGROUND OF THE INVENTION

One popular class of footwear is the sandal, defined by a generally solid base surface that leaves some or all of the side and top of the foot exposed. Typically straps or thongs are used to hold the wearer's foot in place in the sandal. The straps may run over the toes or between the toes. In one well-known sandal design, a thong runs from each side of the base over the top of the foot, terminating in the space between the big toe and the rest of the toes.

Many sandals also include rear straps to secure the heel in place. However, in the popular flip flop sandal design, no rear strap is included. Flip flop sandals are often less secure around the feet but are much easier to don and remove; a flip flop sandal can usually be removed by motion of the foot alone, without the need for hand assistance. For this reason, flip flop sandals are a popular leisure option, and are often used as around the pool, around the house, and in the shower.

Because sandals are understood primarily as a summer option and often associated with leisure applications, many consumers view them as a casual fashion item. More recently, they have become year-round footwear, especially for girls and young women, Sandals, especially flip flop sandals, are marketed in a large number of styles and colors, and consumers are accustomed to purchasing inexpensive flip flop sandals to match a variety of summer outfits, swimwear, and sleepwear.

Because sandals typically show the feet of the wearer, sandals are often associated with bare feet and with visible toenails. Many consumers, especially female consumers, choose to decorate their toenails when wearing sandals. Sandals, especially flip flop sandals, are therefore frequently associated with decorated toenails.

SUMMARY OF THE INVENTION

The present invention is an article of footwear that includes front protrusions that extend beyond the toes of the wearer. The top of each protrusion is decorated.

In one embodiment, there are lights in the top of the each protrusion. The lights are selectively activated by movement of the wearer.

In another embodiment, removable ornaments can be chosen and placed on the top of each protrusion by the wearer.

DETAILED DESCRIPTION

Figure 1:
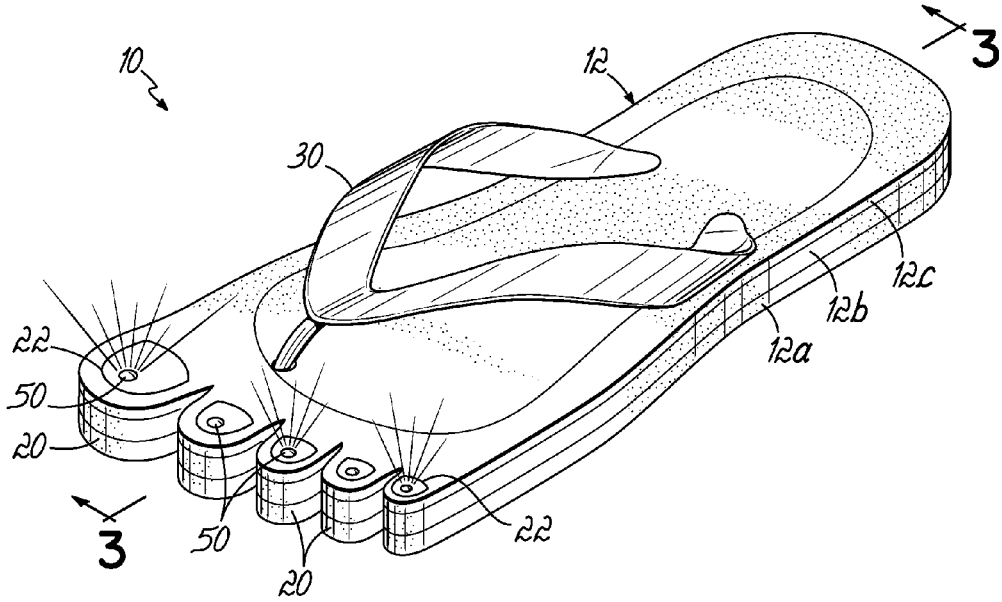
FIG. 1 is a perspective view of a sandal in accordance with one embodiment of the present invention.
Figure 3:
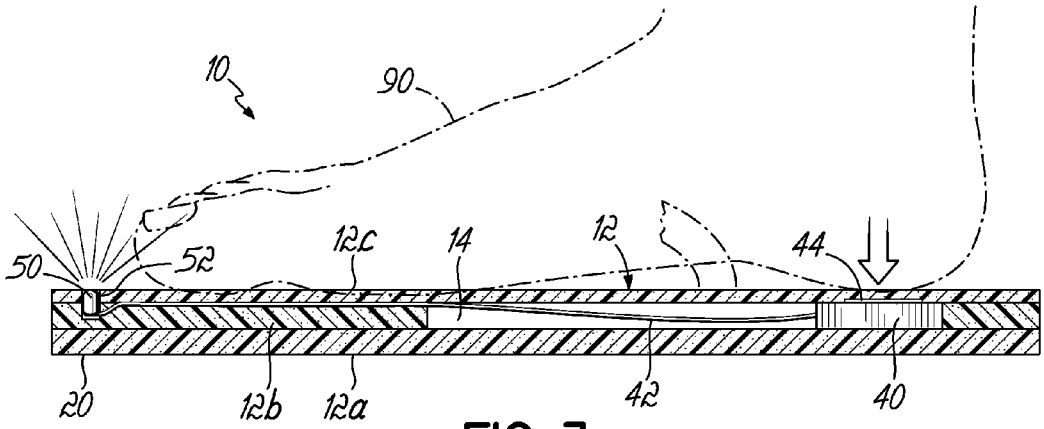
FIG. 3 is cross-section side view of the base of the sandal of FIG. 1 showing the internal heel sensor and light associated with the sandal and a foot in outline.
Figure 2:
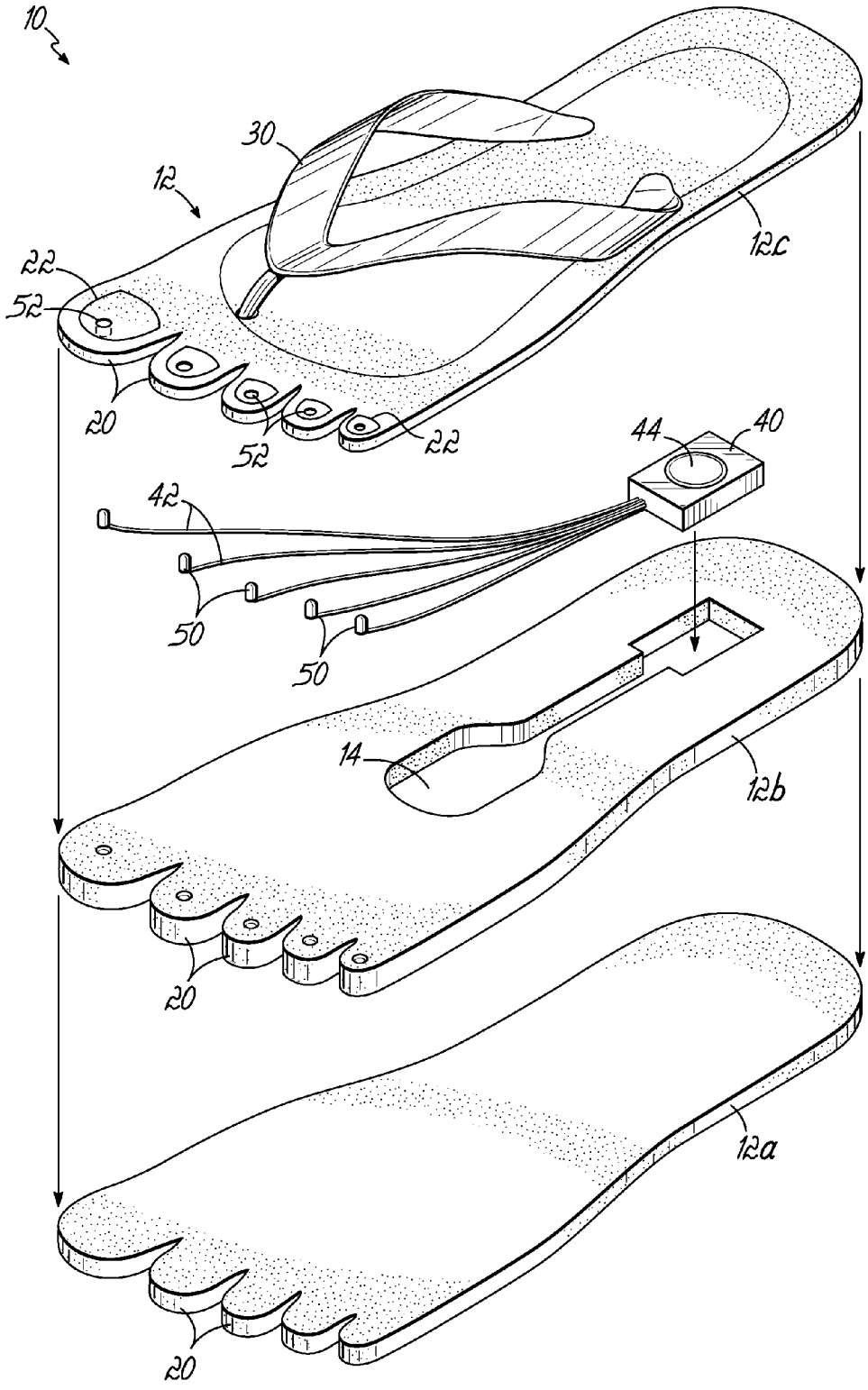
FIG. 2 is an exploded perspective view of the sandal of FIG. 1.

FIGS. 1-3 show a sandal 10, which has a base 12 and at least one strap or thong 30 to secure the base 12 to the foot of the wearer. The sandal 10 is shaped to receive a foot 90 (as shown in FIG. 2), but the base 12 of the sandal 10 is designed to extend past the expected location of the foot 90. The base 12 of the sandal 10 extends forward past the expected location of the toes of the foot 90, and includes protrusions 20 that are themselves shaped like toes. This front part of the base 12, including the toe-shaped protrusions 20, may be slightly upturned in order to accommodate easier movement by the wearer, or alternatively may lie flat with the rest of the base 12 as shown in the accompanying figures. When worn, the toe-shaped protrusions 20 are prominently visible and eye-catching, and fashionably extend the shape and form of the wearer's own feet. The thong is specifically designed to be placed at a location rearward of the toe-shaped protrusions so that the toes of the users foot are positioned rearward of the protrusions so that the plurality of lights are not clocked by any portion of the user's toes when the sandal is worn.

As illustrated in FIG. 1, the sandal 10 shown is a flip flop sandal with a between-toe thong 30 and no heel strap as previously described. The structure of the sandal base 12, including the electronics associated with the toe lights 50, are shown in FIGS. 2 and 3.

The toe-shaped protrusions 20 of the sandal base 12 may include the visual or tactile suggestion of toenails. For example, as shown, each toe shape 20 may be generally of one color but include a toenail-shaped portion 22 in a second color. The toenail shape may be suggested by indicia, by the material of the base itself, or by another method. Alternatively, the toe shapes 20 may not include any suggestion of toenails. Although shown as human toes, one of ordinary skill will understand that other shapes of protrusion (for example, animal toes or claws) may serve the same ornamental function as the toe-shaped protrusions 20. Any plurality of protrusions designed to extend past a foot 90 from the front of the sandal base would be understood to be consistent with the invention.

Whether or not the toe protrusions 20 include the suggestion of toenails 22, in the embodiment illustrated by FIGS. 1-4B, the toe protrusions 20 of the sandal base 12 include light members 50 thereon which are activated during the user's movement.

As shown in FIGS. 2 and 3, the base 12 of the sandal 10 consists of three layers 12*a-c*. The lowest layer 12*a* contains the sole material; it may include grips or a tread pattern on its underside to facilitate the interface between the sole of the sandal and the surfaces on which the user will walk while wearing it. The underside of the lower layer 12*a* may include any features known to one of ordinary skill for the bottom of sandals. The lower layer 12*a* is of the same outline as the rest of the sandal base 12, including the presence of toe protrusions 20.

As shown, the middle layer 12*b* of the base 12 includes a hole 14 in the center part of the arch and heel regions of the base. This hole 14 runs from the heel halfway up the length of the sandal 10. The heel of the middle layer 12*b* includes a control module 40 which contains all the necessary programming and components to run the lights 50 associated with the sandal. For example, the control module may include a circuit board with firmware programmed to accept input from a button or sensor and selectively power the wire circuits associated with each of the toe lights, RAM or other memory, a timer or other reference component, and batteries to power the sandal control module and the toe lights. The control module 40 is coupled to the wires 42 that power the toe lights 50, and also to a heel pressure sensor 44. As shown, the heel pressure sensor 44 is a button that activates when pressed, such as when pressure is applied to the heel as the user walks wearing the sandal 10. The control module 40 may be configured to activate the toe lights 50 randomly, in sequence, or in tandem in response to a sensor event. Any state of the sensor 44 may be a sensor event depending on the configuration of the control module 40. For instance, initiation of pressure may be an event while sustained pressure may cease to be considered an event after a set interval. Likewise, an absence of pressure after a sustained interval of pressure may be an event. Different events may have different patterns of light activation, or the patterns of light activation may be consistent or vary in sequence or randomly regardless of the type of event.

In a simpler embodiment, the control module may comprise a resilient switch that is "on" whenever pressure is applied to the heel and "off" whenever the pressure ceases, the toe lights 50 activating whenever the switch is "on". However, a more complicated control module is shown and contemplated.

The upper layer 12*c*, like the middle and lower layers, has the same cross-sectional area with the same foot shape, including toe protrusions 20. When wearing the sandal 10, the user's foot 90 rests on the top side of the upper layer 12*c*, which may include a variety of fashionable designs as shown. Attached to an area appropriate to the nails 22 of the toe protrusions 20 are a set of lights 50. While LED lights are shown in the figures, one of ordinary skill may be aware of other methods of illumination which will work consistent with the structures described herein. The lights 50 are visible from above, the top side of the upper layer 12*c* having holes 52 matched to each light 50. As shown in more detail in FIG. 4A, the holes 52 may be generally empty and sized to receive the lights 50 as shown. Alternatively, the holes 52 may include a transparent or translucent material which still allows the lights 50 to be seen from above the surface of the top layer 12*c* of the protrusions 20 but provides some covering or protection for the lights 50. The lights 50 are connected by wires 42 which run from the underside of the upper layer 12*c* to the control module 40, the wires 42 running between the upper and middle layers.

Figure 4A:
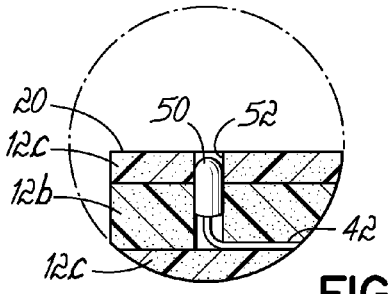
FIG. 4A is a partial cross-section view of a sandal protrusion with a light in accordance with an embodiment of the present invention.
Figure 4B:
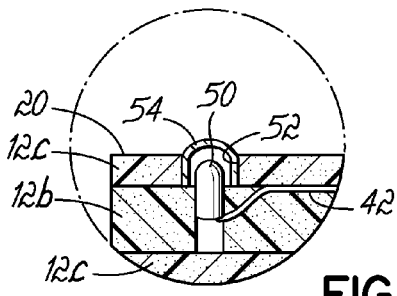
FIG. 4B is a partial cross-section view of a sandal protrusion with a light and covering in accordance with another embodiment of the present invention.

The lights themselves may be any of a variety of shapes, which may match the aesthetic of the sandal. Additionally, the lights may be recessed in holes which are aesthetically shaped. FIG. 4B illustrates that a lens 54 or other transparent or translucent covering may cover some or all of the lights 50 to provide a different shape or color to the lighted areas, to protect the lights 50 from damage, or to optically alter the path of the light emitted by the lights 50. Other advantages and uses of a lens 54 or other transparent or translucent covering for the light 50 will be understood by one of skill in the art.

The lights 50 may be colored, or the light coverings 54 may instead be colored. The lights may each have a distinct shape or color, or lights may share a common shape or color. The coverings may be permanently affixed, or may be in the form of translucent stickers which can be removably affixed by the user to vary the color and shape of the lighted region on each toe protrusion.

Because the top surface of the sandal base may include toenail indicia, shown in some figures as element 22, the lights 50 may be shaped similar to the toenail indicia 22, or in a way complimentary of the indicia 22. Other shapes, sizes, and colors known to one of the art as being complimentary to toenails may be incorporated into the lights 50 themselves or their coverings.

Although embodiments show a sandal base 12 having three layers 12*a*, 12*b*, 12*c* with a hole 14 in the center layer 12*b* allowing for the wires 42 and control module 40, one of ordinary skill in the art would understand other configurations of sandal which allow for the lights 50, wires 42, sensor 44, and control module 40 as described.

Figure 5:
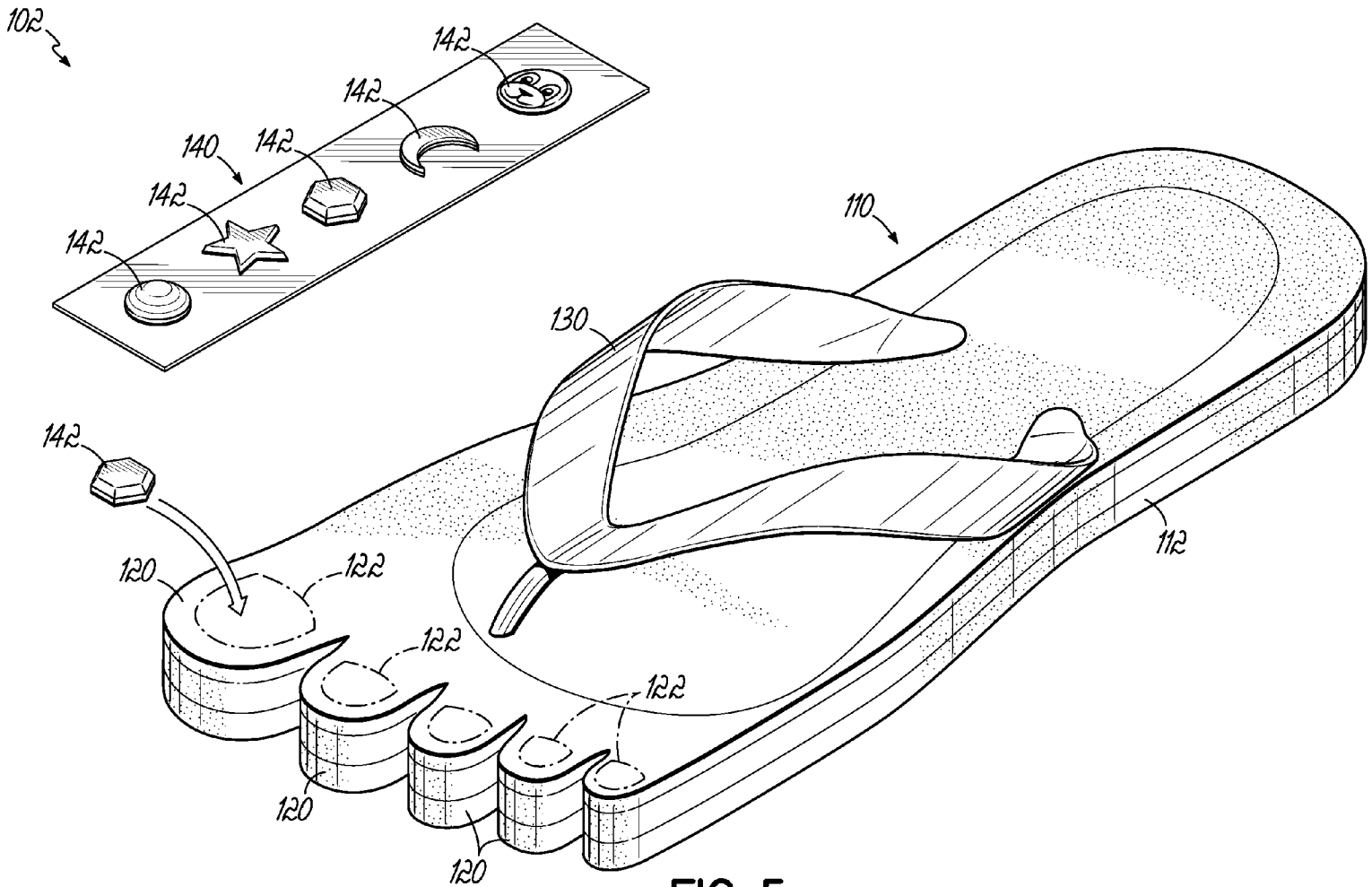
FIG. 5 is a perspective view of a footwear product including a sandal and user-applied ornaments in accordance with the present invention.
Figure 6:
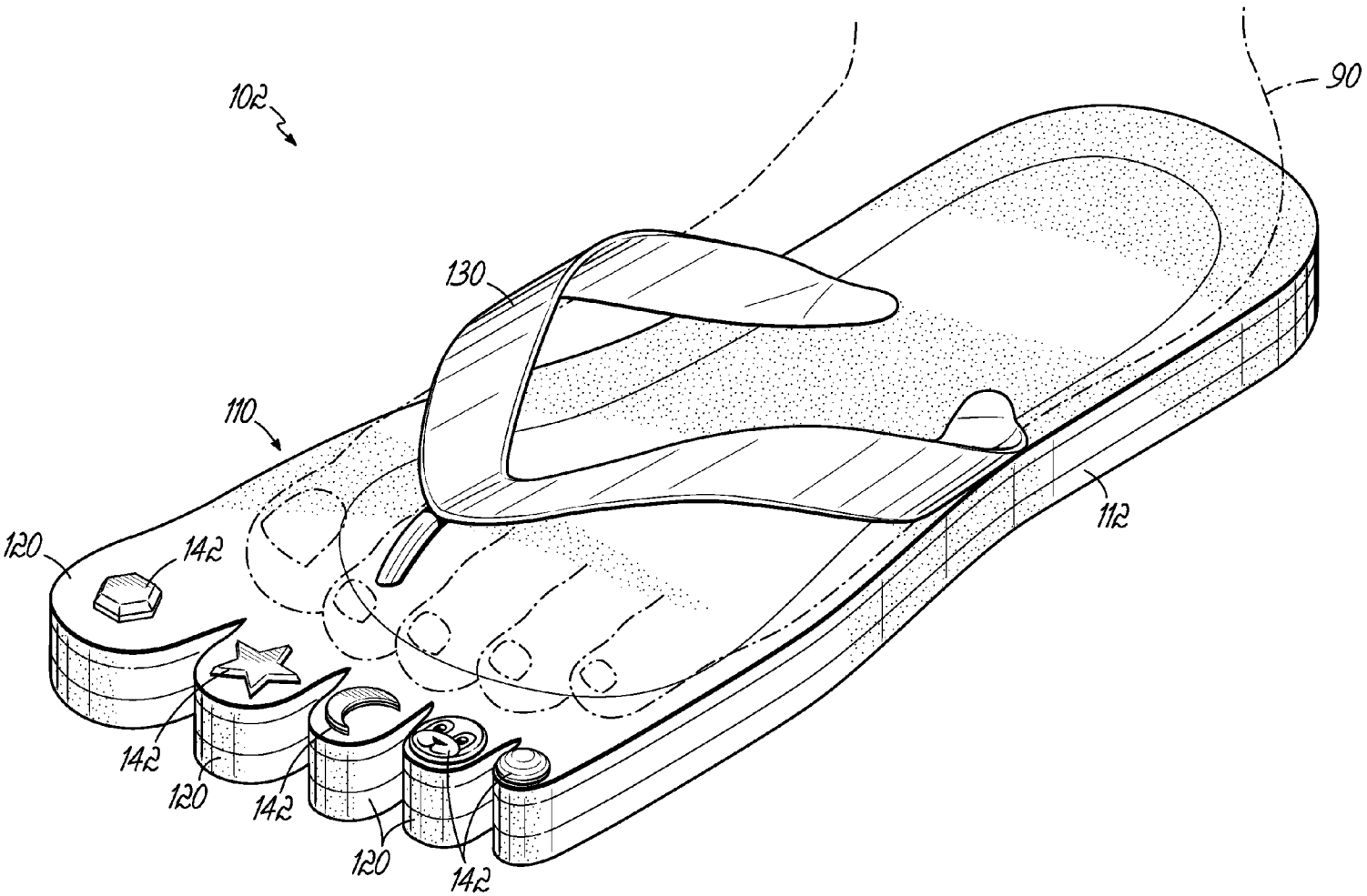
FIG. 6 shows the product with the ornaments applied to the toe protrusions of the sandal and with a foot in outline wearing the sandal.
Figure 7:
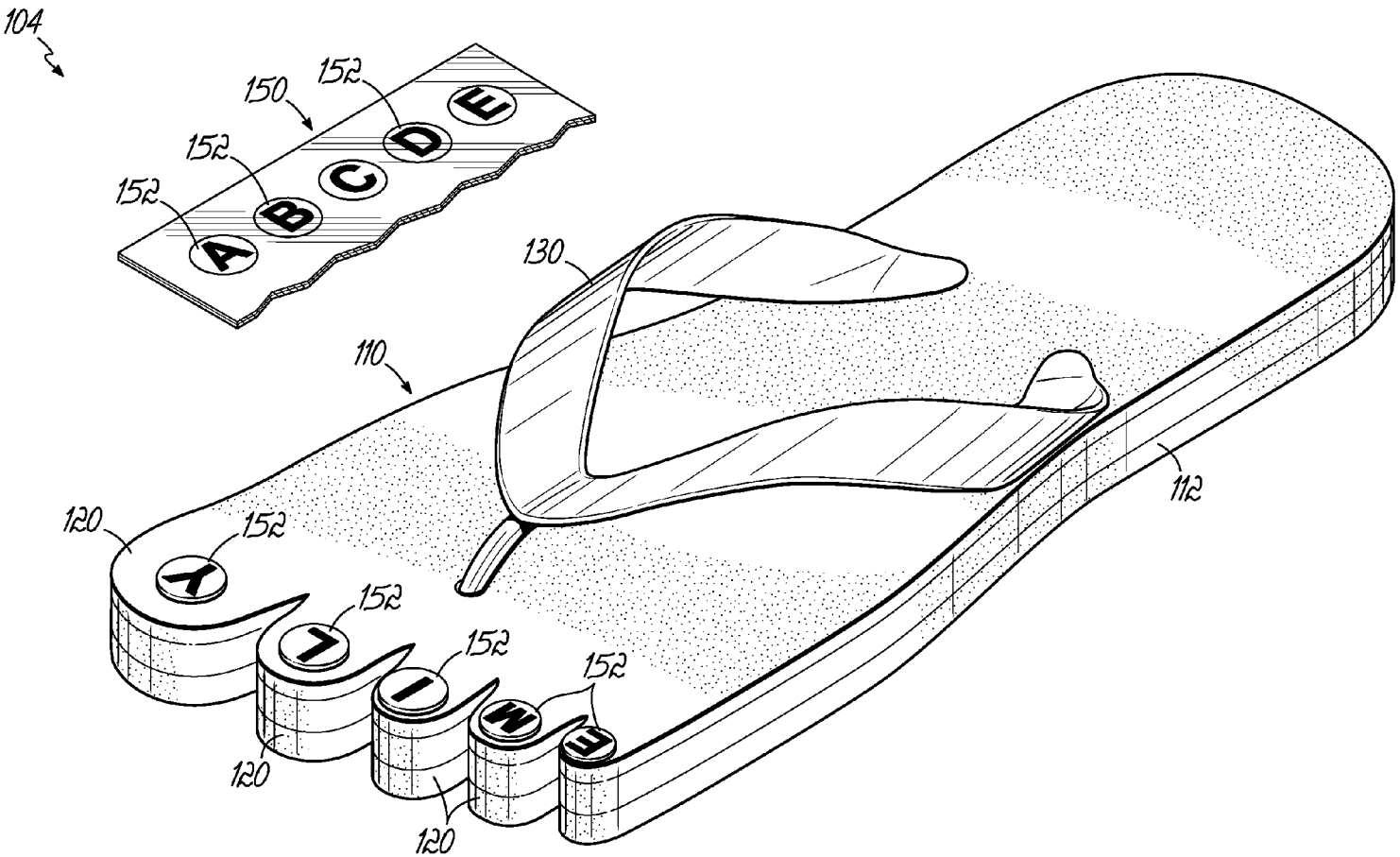
FIG. 7 shows an embodiment of the product with letter ornaments arranged on the toe protrusions of the sandal to spell a word.

FIGS. 5-7 show a fashion footwear product 102, 104 which includes a sandal 110 and ornaments 142, 152. In each figure, the sandal 110 shown is a flip flop sandal with a between-toe thong 130 and no heel strap as previously described.

As above with respect to the sandal 10, the sandal 110 has a base 112 and at least one strap or thong 130 to secure the base 112 to the foot of the wearer. With respect to its shape and architecture, the sandal 110 is as described above with respect to the sandal 10, and the numbers 110-130 correspond to the numbers 10-30 in FIGS. 1-4B as described above. As above, protrusions 120, with or without toenail indicia 122, extend beyond the expected position of a foot 90 as shown.

Whether or not the toe protrusions 120 include the suggestion of toenails 122, the toe protrusions 120 of the sandal base 112 can accept ornaments 142 that are provided to the consumer for custom selection and placement. As shown in FIG. 5, these ornaments 142 may be provided on a card 140 or other packaging and are sized appropriately to be placed in the location of the toenail 122 of each toe protrusion 120. Some of the supplied ornaments 142 may be sized larger or smaller than others to account for the different sizes of toe protrusions 120 or toenails 122, or all ornaments 142 may be of substantially the same size. The ornaments 142 may be two dimensional, such as stickers, or may instead be three-dimensional, such as adhesive gems. The ornaments may be self-adhesive or may require an external adhesive. The ornaments may be designed to be removed after each use or may be designed to be permanently affixed until the user removes and interchanges them. The ornaments may be designed to be placed over other ornaments to conceal previously placed ornaments.

The sandal 110 may be fashionably worn with or without the application of the ornaments 142, which are provided to be used at the wearer's discretion. It is expected that some wearers may choose to cover fewer than all toe protrusions 120 with ornaments 142 while some wearers may choose to cover all toe protrusions 120, thus allowing for a range of different expressions by the wearer. The sandals 110 are depicted as flip flop sandals with a single thong 130 for support, but other thongs or straps, including rear heel straps, may be included in other designs that still incorporate the fashionable toe protrusions 120 of the present invention. The suggestion of toenails 122 on the toe protrusions 120 may also vary; for example they can instead be shaped to match an ornament shape. Toenail portions 122 may be in the shape of a circle, a heart, a commercial logo, etc.

FIG. 7 shows an alternative embodiment of a footwear product 104 that includes ornaments 152 which display letters. As shown in FIG. 3, the footwear product 104 may be sold with a card 150 or other packaging that includes ornaments 152 representing the entire alphabet including punctuation, or may include a more limited set of letters. In one embodiment, the footwear product 104 may be sold with ornaments 152 already arranged on a card 150 or other packaging to show a set of pre-selected words that they may be arranged to display.

Although shown as stickers, ornaments 152 with order-dependent symbols may be gems and represent any suitable two- or three-dimensional shape. Although shown as marks upon a circular background, ornaments 152 could have a shape corresponding to the symbol that each ornament 152 represents. Ornaments 152 may include punctuation, numbers, and other symbols, and some ornaments may have multiple symbols.

A variety of colors, shapes, and materials may be used to carry out the invention as described, and one of ordinary skill in the art will recognize a variety of embodiments from this disclosure and the accompanying figures.

Many features have been listed with particular configurations, options, and embodiments. Any one or more of the features described may be added to or combined with any of the other embodiments or other standard devices to create alternate combinations and embodiments.

Although the examples given include many specificities, they are intended as illustrative of only one possible embodiment of the invention. Other embodiments and modifications will, no doubt, occur to those skilled in the art. Thus, the examples given should only be interpreted as illustrations of some of the preferred embodiments of the invention, and the full scope of the invention should be determined by the appended claims and their legal equivalents.

What is claimed is:

1. A sandal comprising:

a base shaped for receiving a foot, the base is a sandal base having an upper surface shaped for receiving a foot of the user; and the sandal base including a front end and a rear end and further comprising a plurality of protrusions extending outward from the front end; and a plurality of lights embedded within said base each of said plurality of lights located within one of the plurality of protrusions, wherein each of the plurality of lights is configured to activate in response to movement of a user wearing the footwear;

wherein each of the plurality of protrusions is shaped suggestive of a toe of the user, and wherein the toe-shaped protrusions are specifically designed to extend frontwards further then the outermost tip of the toes of a user's foot when the footwear is worn;

wherein the lights are visible on the upper surface of the base extending onto the protrusions;

the sandal further comprising a thong attached to said upper surface of the sandal base and positioned to receive a foot of the user;

wherein said thong is specifically designed to be placed at a location rearward of said toe-shaped protrusions such that the toes of the received foot are positioned rearward of the protrusions so said plurality of lights are not blocked by any portion of said toes when the sandal is worn.

2. The footwear of claim 1, wherein each of the plurality of lights is located within a region of the protrusion suggestive of a toenail.

3. The footwear of claim 1, wherein the sandal base further comprises a recess below the upper surface containing a sensor, the sensor configured to sense the pressure of a foot on the sandal base in order to detect movement of a user wearing the footwear.

4. The footwear of claim 3, further comprising a controller in electrical communication with the sensor and the plurality of lights, the controller configured to selectively activate the plurality of lights in response to signals received from the sensor.

5. The footwear of claim 1, wherein the plurality of lights are LED lights embedded in the protrusions.

6. A sandal comprising:

a base having a sensor configured to detect movement by sensing pressure onto the base;

a plurality of protrusions extending forward from the base, each protrusion having a light configured to selectively activate in response to movement detected by the sensor;

wherein each of the plurality of protrusions is shaped suggestive of a toe of the user, and wherein the toe-shaped protrusions are specifically designed to extend frontwards further then the outermost tip of the toes of a user's foot when the footwear is worn;

a thong coupled to the base and configured to receive a foot of a user;

wherein said thong is specifically designed to be placed at a location rearward of said toe-shaped protrusions such that the toes of the received foot are positioned rearward of the protrusions so said plurality of lights are not blocked by any portion of said toes when the sandal is worn.

7. The sandal of claim 6, wherein the light in each protrusion is embedded below an upper surface of the protrusion, and wherein the upper surface of each protrusion further includes a recess such that the light is visible from above when activated.

8. The sandal of claim 6, wherein each protrusion further includes a dome extending above an upper surface of the protrusion, the dome in optical communication with the light of the protrusion such that illumination from the light can be seen when viewing the dome from above.

* * * * *